United States Patent [19]

Kammann et al.

[11] 4,048,914

[45] Sept. 20, 1977

[54] APPARATUS FOR SCREEN PRINTING IMAGES ON OBJECTS

[75] Inventors: Wilfried Kammann; Manfred Keller, both of Bunde, Germany

[73] Assignee: Werner Kammann Maschinenfabrik, Bunde, Germany

[21] Appl. No.: 625,348

[22] Filed: Oct. 23, 1975

[30] Foreign Application Priority Data

July 8, 1975 Germany ..... 2530360

[51] Int. Cl.[2] ..... B41F 17/20

[52] U.S. Cl. ..... 101/35; 101/40; 101/126

[58] Field of Search ..... 101/35, 38 A, 38 R, 101/39, 40, 126, 123, 124; 198/218, DIG. 8; 214/1 BB, 1 BV, 1 Q, 147 T, 147 R

[56] References Cited

U.S. PATENT DOCUMENTS

| | | | |
|---|---|---|---|
| 2,054,435 | 9/1936 | McQuiston et al. | 101/126 X |
| 2,845,859 | 8/1958 | Gattuso | 198/218 X |
| 2,881,699 | 4/1959 | Hakogi | 101/126 |
| 3,159,100 | 12/1964 | Marquiss | 101/40 |
| 3,533,353 | 10/1970 | Dubuit | 101/40 |
| 3,754,667 | 8/1973 | Storch | 198/218 X |
| 3,757,961 | 9/1973 | Jacobs | 198/218 X |

FOREIGN PATENT DOCUMENTS

| | | | |
|---|---|---|---|
| 457,556 | 5/1950 | Italy | 101/38 A |
| 2,006,059 | 8/1971 | Germany | 101/35 |
| 1,067,099 | 5/1967 | United Kingdom | 101/40 |

*Primary Examiner*—Clifford D. Crowder
*Attorney, Agent, or Firm*—Michael J. Striker

[57] ABSTRACT

A screen printing apparatus includes a stencil and a doctor blade or a squeegee cooperating with the printing screen or stencil to print images on objects. A transportation arrangement is provided for transporting the objects on which the images are to be printed in a given path and direction, part of the path leading past the stencil. The transportation arrangement includes a plurality of pairs of support members which are respectively mounted on carrier elements extending laterally of the path. The carrier elements are mounted on elongated rails for movement longitudinally thereof by a distance corresponding to the spacing of the pairs of support members from one another in said direction, the carrier elements reciprocating in said direction and in an opposite direction relative to the rails. Flexible carrier components may be adjustably connected to the carrier elements, and an arrangement may be provided for flexing the flexible carrier components in direction toward and away from the printing screen or stencil. The rails are mounted for movement toward and away from each other so that the support members may engage and disengage a respective object to be printed between them. At least one intermediate support may be arranged along the path, being operative for temporarily resting an object thereon. The intermediate support may be either stationary or movable in the direction of movement of the objects or opposite thereto.

29 Claims, 14 Drawing Figures

APPARATUS FOR SCREEN PRINTING IMAGES ON OBJECTS

BACKGROUND OF THE INVENTION

The invention relates to screen printing apparatus comprising a printing stencil and a doctor which are movable relative to each other, and a reciprocating carrier for the object to be printed with images including pairs of support members which support the objects.

There is already known a screen printing apparatus in which the object carrier has only one support for supporting the objects during the printing operation. When several images are to be printed on an object, several mutually independent object carriers are to be provided, the objects being transported between the object carriers by conveyors. Thisresults in a relatively complicated construction of the apparatus and also in a cumbersome path for the objects. Moreover, the known screen printing apparatus can only be used for printing images on cylindrical or flat objects.

However, experience with this type of apparatus has shown that it possesses a very important advantage which is to be seen in the fact that an image of substantial dimensions can be applied to the object, regardless of the extent and speed of displacement of the object carrier. However, this advantage is greatly outweighed by the above-mentioned inconveniences associated with this known apparatus.

SUMMARY OF THE INVENTION

Accordingly, it is an object of the present invention in general to avoid the disadvantages of the prior art printing apparatus.

More particularly, it is an object of the present invention to provide a screen printing apparatus which is simple in construction and reliable in operation.

It is a further object of the present invention to provide a novel transporting arrangement for use in connection with a screen printing apparatus which reliably transports the objects on which the images are to be printed.

It is yet another object of the present invention to provide an apparatus which is capable of performing several successive printing operations in the course of only one transportion operation. It is a concomitant object of the present invention to provide a screen printing apparatus which is more versatile than heretofore known so that various images can be applied to objects of different types in the same apparatus.

Still another object of the present invention is to provide a screen printing apparatus which can be easily modified so as to be able to print images on objects of various shapes.

Another object of the present invention is to keep the above-mentioned advantageous feature of the prior apparatus which is the possibility of printing images of substantial dimensions on the objects.

A still further object of the present invention is to provide an apparatus which simplifies printing of images upon objects of substantially elliptical cross sections.

Finally, it is an object of the present invention to provide an apparatus which makes it very easy to properly position the objects relative to the printing screen without impairing the appearance of the printed image.

In pursuance of these objects and others which will become apparent hereafter, one feature of the present invention resides, briefly stated, in an apparatus for printing images on objects which comprises at least one printing stencil and at least one doctor which is associated with the stencil. The apparatus further comprises an arrangement for moving the stencil and the doctor relative to one another, and an arrangement for transporting the objects in a predetermined path and direction past the stencil and including at least two pairs of support members, each pair having a common axis transverse to the path, the support members of each pair being operative for coaxially supporting a respective object, and the paths being spaced from one another in the above-mentioned direction. Finally, the apparatus of the present invention includes at least one intermediate support along the path and operative for temporarily supporting the objects.

More particularly, the invention proposes that an object carrier forming a part of the transportation arrangement have at least two supports, which are spaced apart in the direction of movement of the object carrier by a predetermined distance. What is achieved in this way is that, in the region of the object carrier, the objects perform, depending on the number of the supports and the intermediate supports, a determinable number of transport steps, which are or can be precisely specified regarding their speed, length, point in time, etc. The carrier reciprocates with a constant stroke and it is therefore also possible to provide, without difficulty, conveyor means upstream and downstream of the object carrier which respectively transport the objects thereto and therefrom and which do not require any special setting or adaptation, since the points at which the objects are transferred respectively to the object carrier and from the object carrier to the downstream transport means, are fixed. The number of the supports can be chosen according to the number of the operations to be performed on the objects, the space requirements at any of the printing stations for reciprocating, for example, the screen printing stencil, and other parameters. An arrangement which has been found particularly appropriate is one in which the mutual spacing of the supports corresponds to the stroke of the object carrier.

The intermediate supports, which serve the purpose of holding the object during the return stroke of the object carrier, may be provided with special means which prevents the object from changing its position in or on the intermediate support. These means may, for example, take the form of apertures provided at the intermediate supports, conduit means connecting the apertures to a suction source. The intermediate support may be arranged for reciprocating movement along said path for the purpose of bridging the distance between two adjacent supports on the object carrier. The intermediate support may also be arranged for pivotal movement, preferably through 180°, about the longitudinal axis of the object or an axis parallel thereto, in order to bring, in this manner, the object which has been released by, and during the return stroke of, the object carrier, into the correct position for the next treatment operation. Advantageously the intermediate support has a configuration which is matched to the shape of the object.

A construction which has been found to be particularly advantageous is one in which the object carrier is in two parts and each part carries all support members which are respectively associated with an end region of the object and in which the object carrier is reciprocable transversely to the direction of transportation. What is achieved in this manner is that only one drive is required for the opening and closing movements of the support members, which drive engages the part of the object carrier in question.

In accordance with a further proposal of the invention, the screen printing apparatus may be provided with two, preferably substantially U-shaped, rails which are reciprocable transversely to their longitudinal dimensions, in or by which a respective component carrying the respective support members is guided. This component may be in the form of a push-rod which reciprocates relative to the rail. Each push-rod is advantageously guided by means of rollers inside the rail, and guide flanges may be provided above the push-rods.

Each of the push-rods may preferably be provided with a toothed rack which meshes with a pinion, the pinions of both push-rods being secured to a common shaft. Appropriately, one of the two push-rods is arranged to be driven by a reciprocable slide member or the like. The pinions which are provided on a common shaft may serve the purpose of transmitting the reciprocating movement from one of the push-rods to the other push-rod. The pinions, moreover, also provide synchronization of the movements of the two push-rods.

The support members which carry the objects may be carried by the push-rods. In general, this is advantageous or at least possible where cylindrical objects or objects on which the surface to which the image is to be applied is substantially planar are concerned.

Another possibility resides in an arrangement in which the support members are carried by components of the object carrier which are flexible in a plane extending parallel to the direction of movement of the objects and substantially perpendicular to the screen printing stencil. These components may be in the form of chains, bands, cables or the like. It is currently preferred that the flexible components be, in the region of the screen printing stencil, associated with guide systems, whose construction corresponds to the surface configuration of the object to be printed. Each of the guide systems may consist of a guide member which deflects the flexible component and with which, on the other side of the flexible component, additional guides preferably in the form of rollers, wheels or the like, are associated. The latter are intended to prevent the chain or other flexible component from lifting off from the guide member. It is, of course, also possible to provide rails or the like, which act as guide means and which limit the path to be described by the flexible component on one side or both sides of the flexible component.

It is advantageous to secure the flexible component, preferably detachably, to a push-rod at both terminal regions of the flexible component. In the event that the flexible component is to be deflected, the guide member, rail or the like are arranged between the push-rod and the chain. The guide systems may be carried by the rails. It is, of course, also possible for the arrangement to be such that the flexible component is carried directly by the respective rack. However, attaching the chains or the like to the racks has the advantage of making it exceptionally easy to readapt the machine when changing to other objects to be printed.

When applying a printed image to objects which are of substantially elliptical cross sections, the support members are carried by the chains and—as already mentioned—the arrangement may be such that each support member or guide system is associated with a chain. On the other hand, it is also possible to let a chain run over all the guide systems on one side and to attach all the support members to this chain. The choice between these two possibilities will, among others, depend on whether, when using at any time only one long chain, the variations in length remain within the permissible tolerance limits. If, after the application of printed images to substantially elliptical objects, which necessitate the use of the flexible components and the guide system, printed images are to be applied to, for example, cylindrical objects, it is possible merely to remove the guide systems and to tension the chains or the like. There is no reason why the support members should not remain on the chains. It is, however, also possible to remove the chains and to attach the support members to the push-rods—or to some other rigid components, which participate in the reciprocating movement. In every case it is appropriate to attach the flexible components adjustably to the push-rod in its longitudinal direction at least at one of their ends, in that the distance between the two points of attachment of the chain or the like also depends on the configuration of the guide systems, which are required for the printing of images on objects of substantially elliptical cross sections.

The guide systems may be arranged to be slidably displaceable during the printing operation in, or counter to, the direction of movement of the object. In any case, it is necessary to move the doctor synchronously with the guide system. The advantage of such a configuration consists in the fact that the length of the print can be independent of the stroke of the object carrier. Thus a print of greater length can be applied than it would be possible with a stationary guide system.

When flexible components are used, it is advantageous to connect each support member to the associated flexible component at least at two points which are mutually spaced in the longitudinal direction of this component in such a way that one of these connections permits relative sliding displacement between the support member and the component in the longitudinal direction of the latter. This can be accomplished by providing the connection between the flexible component and the support member at one of the two points of connection by means of an elongated aperture, in which a bolt, pin or the like, of the other part is displaceably engaged.

A drive element, for example the drive slide member, for the object carrier may be alternatively connectable to the driving elements of the doctor and the screen printing stencil, which is generally also in the form of a slide member.

Moreover, it is also possible to interpose the object carrier between two continuous conveyor means for the object, so that, in that event, the object carrier bridges the distance between these two conveyor means.

The advantages achievable by the application of the concepts of the invention may be summarized as providing a large number of possible applications by means of a simple construction. In the case of a two-part object carrier, the devices and systems concerning the drives and movements are, in particular, also simple and conventionally laid out. Overall, few masses require to be moved. The possibility exists of providing several printing stations, so that several prints may be applied to an object successively. Other forms of treatment of the object are also prefectly possible.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2, 3, 4:
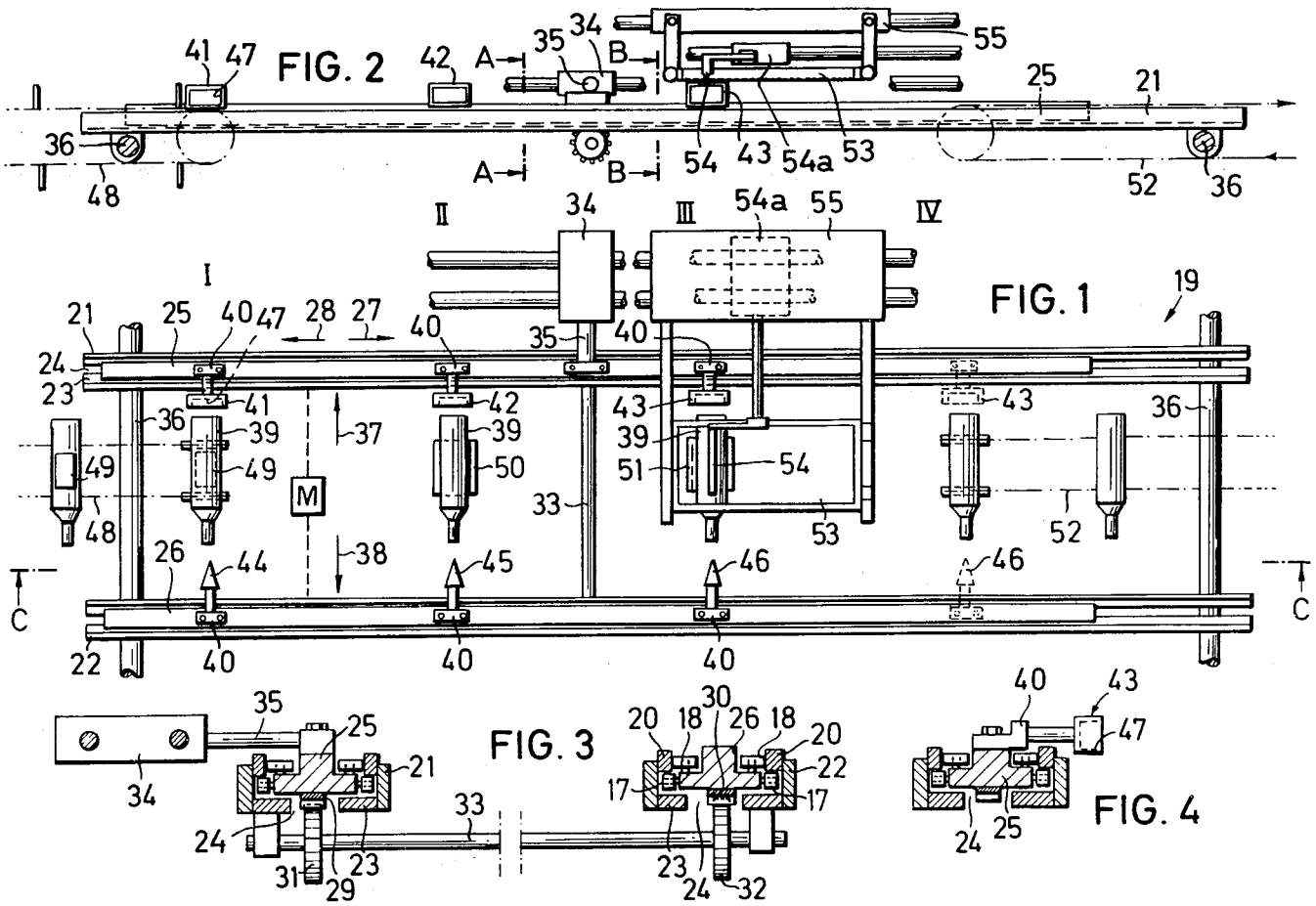
FIG. 1 is a top plan view of a part of a screen printing apparatus of the present invention.
FIG. 2 is a side elevational sectional view taken on line C—C of FIG. 1.
FIG. 3 is a cross-sectional view taken on line A—A of FIG. 2.
FIG. 4 is a partial cross-sectional view taken on line B—B of FIG. 2.

The screen printing apparatus shown in FIGS. 1 to 4 is provided with an object carrier 19 which has two horizontal and mutually parallel U-rails 21, 22, which are spaced from each other. Each U-rail 21, 22 is provided with a longitudinally extending aperture 24 in a web 23 forming the bottom. The rails 21, 22 serve the purpose of receiving and guiding push-rods 25, 26, which are reciprocable inside the two U-rails 21, 22 parallel to their longitudinal dimension in the direction of the arrows 27, 28. On their undersides, the push-rods 25, 26 carry racks 29, 30, each of which meshes with a pinion 31, 32. Both pinions 31, 32 are secured to a common shaft 33. The push-rod 25 cooperates with a slide member 34, which is reciprocable in the direction of the arrows 27, 28 and which is connected to the push-rod 25 via a transverse member 35. The reciprocating movement of the push-rod 25 is transmitted to the push-rod 26, which is arranged inside the U-rail 22, via the rack 29, pinion 31, shaft 33, pinion 32 and rack 30, so that both push-rods 25, 26 are moved in mutual synchronism. The push-rods are, over their longitudinal dimension, provided with rollers 17, 18 which are distributed and which respectively cooperate with two guide rods 20. The latter are rigidly connected to the respective U-rail.

Rollers, now shown in the drawing, may moreover be present, by means of which the push-rods 25, 26 are supported on the botton 23 of the respective associated U-rail 21, 22. The U-rails 21, 22 which are mounted on transverse support members 36 can be moved toward and away from one another in the direction of the arrows 37, 38, i.e. transversely to their longitudinal dimension.

The two U-rails 21, 22 with the push-rods 25, 26 constitute the carrier 19 proper for the objects on which printing is to be done. In the embodiment shown in FIGS. 1 to 4 of the drawing, the objects in question are bottles 39 having rectangular cross-sections. The push-rods 25 and 26 are each provided with three brackets 40, to which there are attached in pairs support members 41, 42, 43, 44, 45, 46 in such a way that the support members 41 and 44, 42 and 45 as well as 43 and 46 face each other respectively. The support members 41 to 46 are matched to the configuration of the object 39 in a conventional manner. This means that the support members 41, 42, 43, which accommodate the bottom end of the object 39, are provided with a recess 47, into which the bottom region fits. The support members 44, 45, 46 are in the form of spikes, so that they can engage in the neck opening of the bottle 39.

The bottles 39 which are supplied via a conveyor belt 48 or the like are, in the embodiment shown in FIGS. 1 to 4 of the drawings, to be printed on one side only, the side on which printing is to take place being determined by the presence of an engraving in the form of a field 49, to which the print is to be applied, the bottles 39 being supplied by the conveyor belt 48 without being oriented with respect to the position of the field 49. This means that the field 49 may be on top or underneath. It is therefore necessary to sense the individual bottles 39 in some way and to rotate through 180° those bottles which assume a position in which the field 49 is underneat, so that the field 49 will face the screen printing stencil 53, which is arranged over the object to be printed, at the commencement of the printing operation at the stencil 53.

The apparatus shown in FIGS. 1 to 4 works in such a way that a bottle 39 which has been advanced by the conveyor belt 48 in the direction of the arrow 27 up to the station I is there engaged by the support members 41 and 44 of the support which is disposed on the left on the object carrier formed by the two U-rails 21, 22 and the associated parts. The manner in which this takes place is that the two U-rails 21, 22 and hence the two push-rods 25, 26 as well as the support members 41 to 43 and 44 to 46 carried by them are moved towards each other. This means that the U-rail 21 with its associated push-rod 25 is moved in the direction of the arrow 38 and the U-rail 22 with its associated push-rod 26 in the direction of the arrow 37. In the course of this movement accomplished by a conventional drivem, the distance between the two support members 41 and 44 as well as that between the support members 42 and 45 and 43, 46 respectively is so reduced that the object 39 located in the station I or on the conveyor belt 48 or on a support element downstream of the conveyor belt 48 is engaged by the two support members 41 and 44. The same applies with regard to the other support members 42, 44 as well as 43, 46, which engage objects located in the stations II and III in the same manner.

Thereafter the two push-rods 25, 26 are moved inside the respectively associated U-rails 21, 22 in the direction of the arrow 27 by appropriate actuation of the slide member 34, the length of the stroke of this movement corresponding to the distance between the support members 41 and 42, 42 and 43; and 44 and 45, 45 and 46 respectively. The distances between the individual stations I and IV are dimensioned accordingly.

In the course of the movement in the direction of the arrow 27, the bottle which is now held by the support members 41 and 44 is transported from the station I to the station II and there released by moving the two support members 41 and 44 apart. For this purpose the two U-rails 21 and 22 are moved apart by the drive M, i.e. they are moved in the direction of the arrows 37, 38, respectively. A stationary intermediate support 50, in which the bottle 39 can be deposited, is associated with the station II. At the end of the stroke in the direction of the arrow 27, all the support members 41 to 43 and 44 to 46 are — with respect to the way in which they are shown in FIGS. 1 and 2 — displaced by one station to the right, so that the two support members 43 and 46 are disposed in the station IV, as shown in dotted lines in FIG. 6 of the drawing.

On the way from I to II, the bottle 39 whose print filed 49 as shown in FIG. 1 faces downwards when received by the two support members 41 and 44, has been turned through 180°, so that the print field 49 faces upwards, as soon as the bottle 39 is deposited in the stationary support 50. This means that the transport stroke from I to II is utilized for the purpose of, if required, bringing the bottle into the correct position for the printing operation. This can be achieved without difficulty by well known means not shown in the drawing which may, for example, involve arranging the support members 41 and 44 in the two brackets 40 rotatably about the longitudinal axis of the bottle 39. All that is then required is suitable conventional means for detecting the position of the object disposed at any one time in the station I, and a conventional control arrangement which, depending on the position of the object, controls the support members 41 and 44 if required. Of course, the positioning may also be accomplished manually. Generally, it will be sufficient to arrange only the support member 41 rotatably, since the object 39 can easily rotate with respect to the spike-like support member 44.

Following release of the object in the station II, the two push-rods 25, 26 and, consequently, also the support members carried by them, are returned to the initial position on the left, shown in FIGS. 1 and 2 of the drawing, in the direction of the arrow 28. Meantime, the conveyor band 48 has transported the next bottle 39 into the station I, which in the course of the following closing movement of the support members 41 and 44 — again effected by a movement of the two U-rails 21 and 22 by the drive M for reducing the spacing — is received by the support members 41 and 44.

As a result of the above-mentioned return movement in the direction of the arrow 28, the two support members 42 and 45 again move from the station III to the station II, i.e. into the position shown in FIGS. 1 to 2. In the course of the closing movement they engage the object disposed on the stationary intermediate support 50. Thereafter, the intermediate support 50 is lowered slightly, in order to release the object. In the course of the following movement of the two push-rods 25 and 26 in the direction of the arrow 27 this object reaches the station III, the object received in the station I reaching the station II simultaneously and synchronously therewith. In the course of the opening movement this object is deposited on the intermediate support 50, which has meantime again been raised into its initial position. The object disposed in the station III is deposited on a stationary intermediate support 51 located thereat, which is also capable of slight upward and downward movement. The two push-rods 25 and 26 are then again returned to the left-hand terminal position in the direction of the arrow 28, the right-hand support, which consists of the members 43 and 46, now reaching the station III, there in the course of the following closing movement receiving the object which is disposed in the stationary intermediate support 51 and transporting it in the course of the following stroke into the station IV in the direction of the arrow 27, where it is deposited on discharging transport means 52 after opening of the support 43, 46. In the course of this transport step the image has been applied to the bottle. For this purpose a screen printing stencil 53 with an associated doctor 54 is provided between the two stations III and IV. The screen printing stencil is reciprocated by means of a slide member 55 in the direction of the arrows 27 and 28, being moved synchronously with the object to be printed, in the direction of the arrow 27 during the printing operation. The doctor or squeege 54 which is carried by a slide member **54*a* may be stationary. It may however also be moved relative to the screen printing stencil 53 either in the direction of the arrow 27 or that of the arrow 28.**

While the object is being transported from I to II or from II to III, some pretreatment operations, such as flame treatment, dust removal or the like, may be performed, which are necessary in order to achieve a satisfactory print and which were not, or could not be, performed while the object was being advanced on the conveyor belt 48.

The arrangement shown in FIGS. 1 and 2 may also be modified in such a manner that further printing stations may be provided, for example between the stations I and II. This may be possible or necessary where two partial images are to be combined into a complete image. In this case it may be necessary, at the intermediate support 50 and possibly also during the transport from II to III, to treat the first partial image in order to dry the latter sufficiently to render possible the application of the next partial print in the course of the transport step from III to IV. In practice this applies to all forms of the object which are encountered, i.e. for printing on surfaces which are flat, of substantially circular cross-section or of substantially elliptical cross-section.

The embodiment in accordance with FIGS. 1 to 4 has been described above with reference to the so-called flat print, in which objects are printed, whose surface to which the image is to be applied is substantially planar. With the embodiment in accordance with FIGS. 1 to 4, it is of course equally possible to print objects of substantially circular cross-sections. For this purpose it is — apart from the support members, which anyway have to be matched in each case to the form and size of the object concerned — necessary to arrange the screen printing stencil 53 in such a way that a relative velocity is present between it and the object during the printing operation. This means that in this case the movement of the doctor 54 would have to be proportionate to the movement of the object carrier.

The embodiment in accordance with FIGS. 6 to 9 is similar to that described in connection with FIGS. 1 to 4 so far as the essential parts are concerned. It has, however, some additional devices for printing on both sides of objects of substantially elliptical cross-section. To the extent to which similar parts are provided, they are designated with those reference numerals which have already been used in FIGS. 1 to 4.

A significant difference between the two embodiments resides in the fact that the support members 41 and 42, as well as 44 and 46 are carried by chains 56, 57, 58, 59, whose ends are in turn attached to the push rods 25 and 26 respectively. These chains are so constructed and/or arranged, that they are flexible in a plane perpendicular to the longitudinal axis of the objects to be printed, which here also are in the form of bottles 39. The ends of the chains 56 to 59 are releasably attached to the push rods 25, 26 respectively by the use of blocks 60 or the like.

A further difference resides in the fact that each chain 56, 57, 58, 59 is associated with a guide member 61, 62, 63, 64, the shape of which corresponds to the outline of the surface of the object to be printed, as regards the surface which cooperates with the chain 56 to 59. These guides members 61 and 64 are attached to lateral extensions 65 of the U-rails 21, 22 in the region of the screen printing stencil 53, 153 in such a way that they extend beyond the push rods 25, 26 at least in that width which corresponds to the width of the chains 56 to 59. The latter are laid over these guide members 61 to 64, so that, in the course of reciprocation of the push rods 21, 22, in which the chains 56 to 59 are required to take part, the latter are deflected about the associated guide member 61 to 64 concerned. Since the support members are also each attached to one of the chains 56 to 59, they are constrained to take part in this deflection movement. The guide members 61 to 64 may be stationary. The screen printing stencils 153 and 53 are moved synchronously with the object 39 to be printed during the printing operation. The doctors 54 and 154 may be stationary. They extend along the line at which contact is established between the screen printing stencil 53 and 153 and the object 39 during the printing operation.

A further difference with regard to the embodiment in accordance with FIGS. 1 to 4 consists in the fact that a total of only two supports 41, 44 and 43, 46 is present. For the same stroke of the push rods 25, 26 in the direction of the arrows 27, 28, and for the same distance between the support members 41 and 43, and 44 and 46 respectively, in the embodiment in accordance with FIGS. 5 to 9, one of the transport steps of the objects in the direction of the arrow 27 is effected by an intermediate support 150, which is here reciprocable between the stations II and III.

Figures 5, 6, 7, 8, 9:
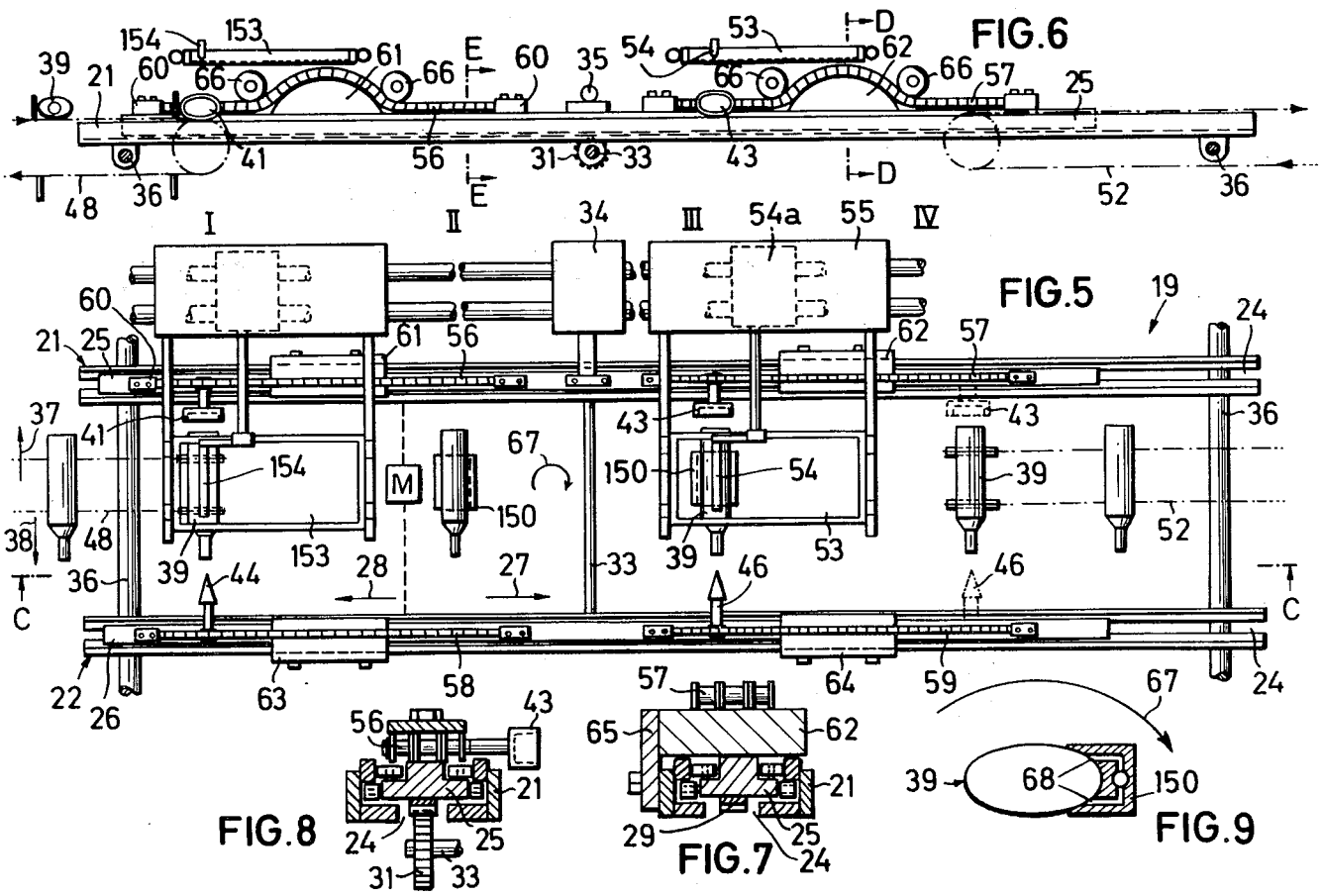
FIG. 5 is a view corresponding to FIG. 1, but illustrating a different embodiment of the invention.
FIG. 6 is a side elevational view substantially taken on line C'—C' of FIG. 5.
FIG. 7 is a cross-sectional view taken on line D—D of FIG. 6.
FIG 8 is a cross-sectional view taken on line E—E of FIG. 6.
FIG. 9 illustrates a detail of the apparatus in a diagrammatic side view.

The chains 56 to 59 are, in the region of the guide members 61 to 64, associated with guide rollers 66 which, for sake of clarity, are not shown in FIG. 5 of the drawing. In consequence, the chains 56 to 59 are, over practically the entire perimeter surface of the guide members 61 to 64, which is matched to the outline of the surface of the object to be printed, contiguous to this perimeter surface.

The object 39 which is received in the station I by the transport means 48, is brought into the station II in the course of the transport stroke of the push rods 25, 26 in the direction of the arrow 27 and deposited on the intermediate support 150 which is located there at this point in time. By means of the screen printing stencil 153 and the doctor 154, during the transport from I to II, the print is applied to one side of the bottle 39, which had been deflected and rotated by the two guide members 61, 63 according to the outline of the surface to be printed. The intermediate support 150, on which the object is held in a suitable manner, is moved into the station III. In the course of this transport step in the direction of the arrow 27, the intermediate support 150, which is of substantially U-shaped cross-section (FIG. 9), is rotated through 180°. This is indicated by the arrow 67. The internal boundary surfaces of the intermediate support are provided with bores 68, which can be connected to a suction source by non-illustrated conduit means. Generally the arrangement is such that the intermediate support 150 consists of two parts which are mutually spacedly arranged and which engage the object 39 by their terminal regions, where no printing is to be applied to the object 39. On the other hand, it is also possible to make the intermediate support 150 in one piece, for example where the central region of the bottle does not have an image applied to it. In particular its configuration will depend on the shape of the object and the position of the printed matter.

In any case, at the station III, the object is removed from the intermediate support 150 by the support 43, 46 which had been brought into the left-hand terminal position shown in FIG. 5 of the drawing in the course of the preceding movement of the two push rods 25, 26 in the direction of the arrow 28. It can be carried out during the period in which the intermediate support 150 brings the object from II to III. In the course of the subsequent transport of the object from III to IV the second print is applied by the screen printing stencil 53 and the doctor 54, the guide members 62, 64 effecting the deflection and rotation of the object. In the station IV the finished printed object is laid onto a discharging transport means 52. The position of the two opened support members 43 and 46 in the station IV is shown is dotted lines in FIG. 5 of the drawing. It corresponds to the right-hand terminal position of the two push rods 25, 26, the support member 41 and 44 then being located in the station II.

Particularly from FIG. 6 it can be seen that a displacement of the push rods 25, 26 in the direction of the arrow 27 results in a corresponding movement of the chains 56 to 59 carrying the support members 41, 44 and 43, 36 about the associated guide members 61 to 64. By the deflection of the chain about the guide members a corresponding movement is transmitted to the respective support member carried by it, in which movement the object carried by the support members is also constrained to take part. As the result thereof, the object carries out a rolling movement relative to the respective screen printing stencil 153 or 53, without however any relative movement between the object and the stencil being produced in, or counter to, the direction of the arrow 27. It is also for this reason that the respective associated doctor 154 or 54 is arranged to be stationary on the line in which the contact between the object and the screen printing stencil takes place in the course of the movement of the two parts in the direction of the arrow 27. The axis about which the rotary movement of the object, effected by the guide members, takes place, is generally not at the center of the object. Moreover, this axis may perfectly well change its position during the printing operation, so that it is also possible to print in one operation such objects in which the surface to be printed is composed of sections having different radii of curvature. In this case, like in all other cases, it is merely necessary to match the shape of the cross-section of the guide members 61 to 64 to the outline of the surface to be printed.

Where hereinbefore mention has been made of an elliptical cross-sectional shape, it is meant to indicate in particular that the axis about which the object is rotated is as a rule disposed outside the object and that moreover the object can roll by its surface to which the print is to be applied over the screen printing stencil. It is however not intended to cannote essentially and exclusively an elliptical cross-sectional area, in the strict geometric sense. Instead, as already mentioned, it is by application of the concepts of the invention, also possible to print surfaces which are composed of regions of different radii of curvature, such that a change in the position of the axis about which the rotation of the object takes place is necessary during the printing operation.

It is also possible to use, without difficulty, the embodiment shown in FIGS. 5 to 9 for printing on cylindrical or flat objects. For this purpose it is merely necessary to remove the guide members 61 to 64 and to tension the chains 56 to 59. When applying print to cylindrical or flat objects, it is, of course, also possible to remove the chains and to attach the support members 41, 44, etc. to the push rods. The embodiment in accordance with FIGS. 1 to 4 is then obtained. It is moreover also possible to provide on each push-rod only one chain whose length will depend on the length of the stroke and also the number of the support members.

The support members 41 to 46 are connected to the chains 56 to 59 at two mutually spaced points. In the case where objects which are to be deflected are printed in accordance with the embodiment of FIGS. 5 to 9, one of the points of attachment is such that relative displacement between the chain and the support in the longitudinal direction of the chain is possible. Appropriately this is effected by means of an elongated aperture in one of the parts, in which a pin or bolt of the other part engages, which is slidably displaceable inside the elongated aperture.

It is moreover even possible to displace the guide members 61 to 64 absolutely during the printing operation. In this case the associated doctor 153 or 53 would also have to be displaceable, while at the same time it would also be possible to move the screen printing stencil 153 or 53 in, or counter to, the direction of the arrow 27 with respect to the object. In the end result, a movement would take place which corresponds to the rolling operation in the printing of a cylindrical object.

The extraordinarily wide range of application of the screen printing machine in accordance with the invention is also apparent from the different movements and arrangements of printing facilities shown diagrammatically in FIGS. 10 to 14.

Figure 10:
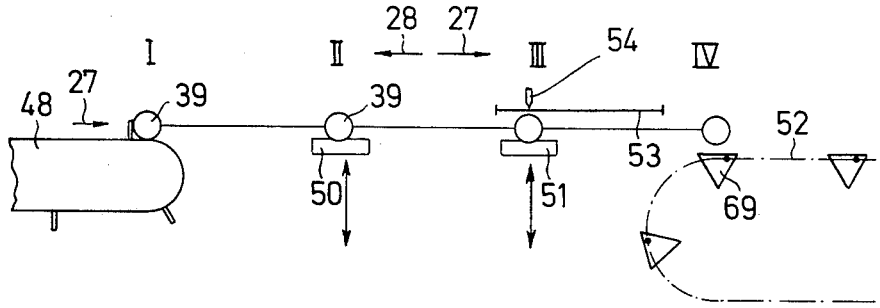
FIGS. 10 to 14 each show diagrammatically the sequence of movements relating to different printing operations.

FIG. 10 shows the sequence of movements concerned in a single application of print to a cylindrical object. The apparatus is provided with three support members (not shown) for the objects. The object 39 supplied at any one time by the transport means 48 is taken over at the station I by the support of the object carrier located on the left. In the course of the following stroke in the direction of the arrow 27, the object 39 is brought into the station II and released there by the two support members moving apart. The station II is associated with a stationary intermediate support 50, in which the object is deposited. Following release of the object in the station II, the object carrier is returned to its initial position on the left in the direction of the arrow 28, the central one of the supports located on the object carrier getting into the station II. In the course of the following closing movement of the support members, they engage the object which is located there and which subsequently, in the course of the following movement in the direction of the arrow 27, is transported into the station III and there deposited on a second intermediate support 51 in the course of the opening movement of the support members. Simultaneously, during the transport of the object from the intermediate support 50 into the intermediate support 51, i.e. from II to III, a further object was received in the station I and transported to II.

In the course of the succeeding transport stroke in the direction of the arrow 27, the object is transported into the station IV, where it is deposited on a carrier 69 of a transport means 52 after opening of the support member.

During the transport of the object from I to II a preliminary treatment may be carried out, which, for example, consists in applying a flame to, and/or removing dust from, the object. This also applies to the transport from II to III. It is moreover possible, in the course of one or both of these movements, to align the object, which is printed during the transport stroke from III to IV. At the high throughput performances of printing machines which are customary these days, there is no longer very much time available for alignment during the stroke in the course of which the printing takes place. It is, therefore, necessary for the objects to assume at least approximately the angular position corresponding to the position at the commencement of the printing operation, directly before the commencement of this stroke. Only slight corrections in the form of rotation of the object about its longitudinal axis are possible. This means that prealignment is desirable or necessary, which takes place in one of the preceding transport strokes and which effects the angular position of the object required for the commencement of the printing operation except for a deviation of perhaps 10%. During the printing stroke only slight rotation into the proper position is then still required, for which the time available is adequate.

In the embodiment in accordance with FIG. 10 only one printing operation is performed in the course of three transport strokes. It is of course also possible to perform an additional printing operation, for example during the movement of the object from II to III.

The same sequence of movements occurs in the course of the application of print to one side of flat objects, if both of the opposite sides of the object are equivalent from the point of view of the printing technology and it is consequently immaterial whether the print is applied to one or other of the two sides. Differences consist merely as regards the relative movements of the cooperating parts in the printing station, i.e. particularly the movement of the object, doctor and screen printing stencil.

Figure 11:
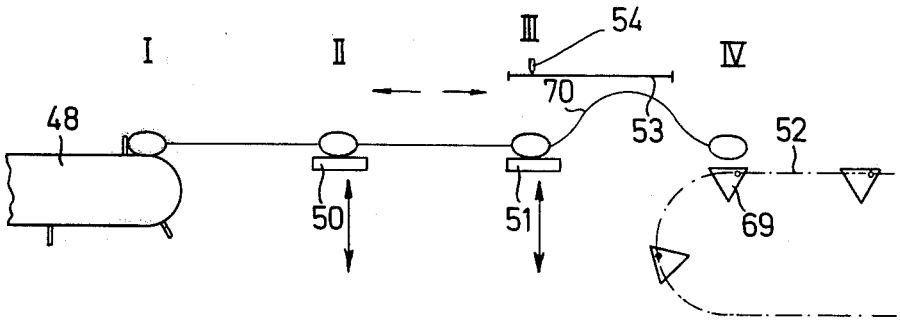

The sequence of movements for printing on one side of objects of substantially elliptical cross-section, shown in FIG. 11, basically corresponds to the sequence of movements in accordance with FIG. 10, the two opposite sides of the object, only one of which is to be printed, being here also equivalent from the point of view of printing technology. Regarding the movement of the doctor 54 and screen printing stencil 53 there is a similarity to the printing of planar surfaces to the extent to which the screen printing stencil is movable synchronously with the object carrier and, if desired, connected to the latter so as to move therewith. Additionally, for the purpose of achieving the necessary rotary movement of the object about an axis parallel to its longitudinal dimension, guide members are provided, which determine the path followed by the flexible object carriers. If these guide members are arranged so as to be stationary, then the doctor is also arranged so as to be immovable. Otherwise there is correspondence regarding the movement of the object to be printed from the station I into the station IV with the sequence of movements in accordance with FIG. 10.

Figure 13:
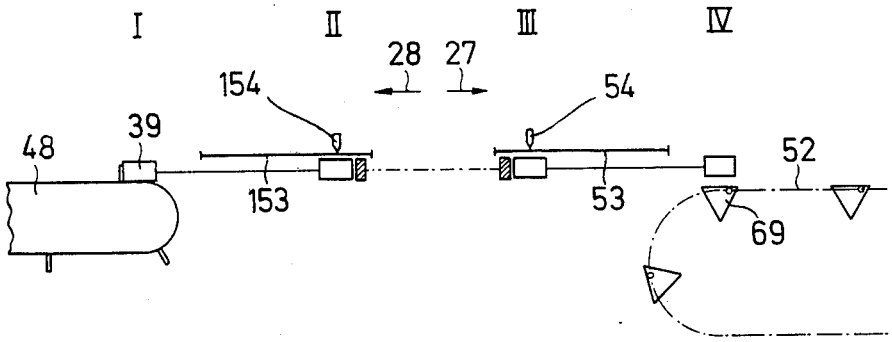

The embodiment in accordance with FIG. 13 relates to the application of print to objects on at least two substantially planar surfaces, which in this particular case are opposite each other. For an appropriate cross-sectional shape of the object or an appropriate arrangement of the supports, it is however also possible to apply print consecutively to two, or also a larger number of, surfaces, which are arranged at angles to each other, preferably at right angles.

Figure 12:
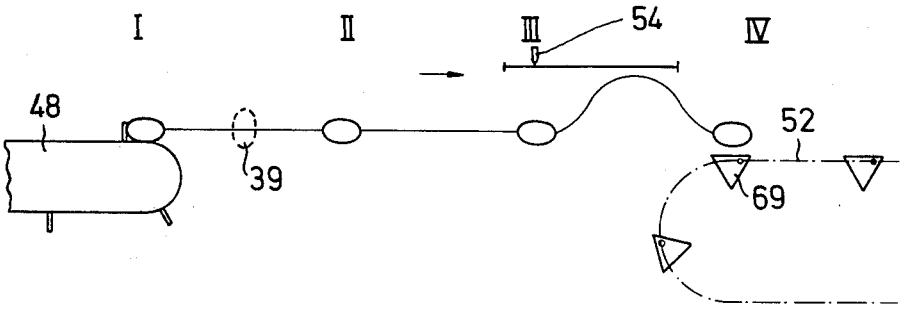

Regarding the sequence of movements, a significant difference as compared with the embodiment in accordance with FIGS. 10 and 12 resides in the fact that the object carrier is provided with only two receiving means, which are associated with only one intermediate carrier 150, which in turn is arranged to be reciprocable between the stations II and III. The object 39 which is engaged by the left-hand support of the object carrier in the station I is transported into the station II in the direction of the arrow 27 and deposited in the intermediate support 150 which is located there. During the transport from I to II the application of an image takes place on the side of the object which is uppermost during this transport step. This is achieved due to the action of the doctor 154 and of the screen printing stencil 153, the screen printing stencil being movable synchronously with the object.

Figure 14:
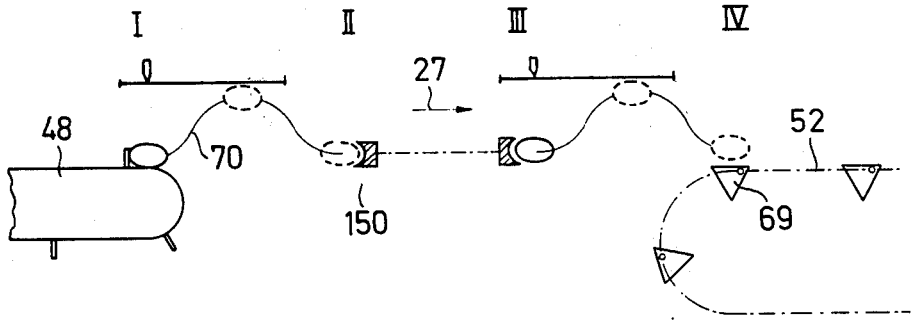

As soon as the object is located in the intermediate support 150 in the station II, the intermediate support 150 is displaced into the station III. During this transporting step the object is rotated by appropriate rotation of the intermediate support 150 through 180°, so that the side which had previously been printed during the transport step from I to II now lies underneath in the station III. Upon completion of the transport stroke of the intermediate support 150, the right-hand support of the object carrier is also located in the station III, so that this support can be closed for the purpose of engaging the object. In the course of the following transport step in the direction of the arrow 27 from III to IV the printing of the other side of the object then takes place by the screen printing stencil 53 with the doctor 54 located between the stations, III and IV. In the station IV, i.e. upon completion of the second printing operation, the object is, for example, deposited on the discharging transport means 52, in the conventional manner. The sequence of movements thus agrees to a large extent with the embodiment in accordance with FIGS. 5 to 9, whose sequence of movements is shown in FIG. 14. The first printing operation takes place during the transport from I to II, the object describing the path 70 to which it is constrained by the guide members and simultaneously being subjected to a rotation. The object which is subsequently engaged by the intermediate support 150 is brought into the station III, at the same time rotated through 180° and engaged by the right-hand support of the object carrier in the station III and, in the course of the succeeding movement in the direction of the arrow 27, moved into the station IV, the second printing operation being performed during the transport step from III to IV simultaneously with the deflection and rotation of the object.

In the embodiments in accordance with FIGS. 1–4, 10 and 13, the distance between the screen printing stencil proper and the level at which the surface to be printed during the transport is disposed is so small that the slight deformation of the printing stencil 53 caused by the doctor 54 is sufficient for bringing the printing stencil 53 and the object 39 into mutual contact during the printing operation.

The support members may also be constructed differently from those in the examples shown in the drawings. This will depend on the configuration and the nature of the object to be printed.

The absolute and relative movements of the doctor, screen printing stencil and the object or object carrier and the cooperation between these parts in the printing station concerned is basically in accordance with the teaching according to U.S. Pat. No. 3,874,289. Consequently, also drives for the cooperating parts and other systems may be utilized which are described in the abovementioned patent.

It will be understood that each of the elements described above, or two or more together, may also find a useful application in other types of constructions differing from the types described above.

While the invention has been illustrated and described as embodied in a screen printing apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for printing images on objects, comprising at least one printing stencil; at least one doctor associated with said stencil; means for moving said stencil and doctor relative to one another; means for transporting the objects in a predetermined path and direction past said stencil, including a carrier extending along said path and mounted for reciprocation in said direction and opposite thereto by a given distance and at least two pairs of support members connected to said carrier to share the reciprocatory movement thereof and being spaced from one another by said distance, each of said pairs having a common axis transverse to said path and being operative for coaxially supporting a respective object, said carrier including at least one carrier component which is flexible in a plane extending parallel to said direction and substantially normal to said stencil, said support members being mounted on said flexible carrier component; means for flexing said carrier component in said plane and including a guide member in engagement with said carrier component and having a configuration which is dependent on the shape of the object transported thereby, and a plurality of rollers engaging said carrier component opposite said guide member; and at least one intermediate support along said path for temporarily supporting the objects.

2. An apparatus for printing images on objects, comprising at least one printing stencil; at least one doctor associated with said stencil; means for moving said stencil and doctor relative to one another; means for transporting the objects in a predetermined path and direction past said stencil, including a carrier extending along said path and mounted for reciprocation in said direction and opposite thereto by a given distance and at least two pairs of support members connected to said carrier to share the recriprocatory movement thereof and being spaced from one another by said distance, each of said pairs having a common axis transverse to said path and being operative for coaxially supporting a respective object, said carrier including a pair of rigid rod-shaped carrier elements, and a pair of flexible carrier components having longitudinally spaced end portions connected to said carrier elements as longitudinally spaced locations of the latter, said carrier elements and components of each pair being located laterally of said path; and at least one intermediate support along said path for temporarily supporting the objects.

3. An apparatus as defined in claim 2, wherein said end portions are detachably connected to said carrier elements.

4. An apparatus as defined in claim 3; and further including means for adjustably connecting at least one of said end portions to said carrier element to thereby adjust the length of said carrier component.

5. An apparatus for printing images on objects, comprising at least one printing stencil; at least one doctor associated with said stencil; means for moving said stencil and doctor relative to one another; means for transporting the objects in a predetermined path and direction past said stencil, including two carrier elements each extending along said path at one side thereof and mounted for reciprocation in said direction and opposite thereto by a given distance and at least two pairs of support members, each support member of a respective pair being connected to one of said carrier elements to share the reciprocatory movement thereof, said pairs being spaced from one another by said distance and each having a common axis transverse to said path and being operative for coaxially supporting a respective object; means for mounting said carrier elements for movement toward and away from one another transversely of said direction, including a pair of elongated rails extending along said path and operative for guiding said carrier elements for reciprocation longitudinally thereof, and means for moving said rails toward and away from one another; and at least one intermediate support along said path for temporarily supporting the objects.

6. An apparatus as defined in claim 5, wherein said intermediate support is provided with apertures; and further including conduit means for connecting said apertures to a suction source to thereby engage said intermediate support with an object supported thereon.

7. An apparatus as defined in claim 5; and further including means for mounting said intermediate support for reciprocation along said path.

8. An apparatus as defined in claim 5; and further including means for mounting said intermediate support for pivoting movement about a pivot axis parallel to said common axis, to thereby change the orientation of the object transported in said path.

9. An apparatus as defined in claim 5, wherein said intermediate support is formed with at least one depression for matchingly receiving a portion of a respective object therein.

10. An apparatus as defined in claim 5, wherein each of said carrier elements is elongated; and wherein each of said rails is substantially U-shaped and at least partially surrounds the associated carrier element for guiding the same.

11. An apparatus as defined in claim 10, wherein each of said rail is provided with flanges also partially surrounding the associated carrier element.

12. An apparatus as defined in claim 10, wherein each of said elongated carrier elements is provided with a toothed rack extending longitudinally thereof; and further comprising a pair of pinions mounted for rotation and meshing with the respective toothed racks, and means for connecting said pinions for simultaneous rotation so as to displace said elongated carrier elements longitudinally of the associated rails.

13. An apparatus as defined in claim 10, and further comprising means for simultaneously moving said carrier elements longitudinally of said rails, including a pair of toothed racks provided on said elongated carrier elements and extending longitudinally thereof, and a pair of pinions mounted on a shared shaft for rotation therewith and respectively meshing with said toothed racks.

14. An apparatus as defined in claim 13, wherein said transporting means includes a driving member mounted for reciprocation in said direction and rigidly connected with one of said carrier elements to reciprocate the same, whereby the other carrier element is simultaneously reciprocated via said toothed racks, said pinions and said shared shaft.

15. An apparatus as defined in claim 5, and further including a plurality of rollers associated with said rails and carrier elements and operative for guiding the latter in the former longitudinally thereof.

16. An apparatus as defined in claim 5, wherein said carrier elements are rigid and rod-shaped.

17. An apparatus as defined in claim 5; and further comprising means for coupling said transporting means with said stencil to obtain proportionate displacement thereof.

18. An apparatus as defined in claim 5; and further comprising means for coupling said transporting means with said doctor to obtain proportionate displacement thereof.

19. An apparatus as defined in claim 5; and further comprising a first conveyor mean for supplying unprinted objects; second conveyor means for withdrawing printed objects; and wherein said transportation means extends between and cooperates with said first and second conveyor means.

20. An apparatus for printing images on printing surfaces of objects, comprising at least one printing stencil; at least one doctor associated with said stencil; means for moving said stencil and doctor relative to one another; and means for transporting a succession of objects past said stencil along a plane normal to the latter, including at least one reciprocatable flexible carrier component, support means mounted on said carrier component and operative for supporting the respective object, means for reciprocating said carrier component along said plane by a predetermined distance for moving the respective object supported by said support means past said stencil and for returning said support means into a position for accepting a successive object, and means for flexing said carrier component parallel to said plane, including a guide member having a guide surface over which said carrier component is trained and having a configuration which is so correlated to the particular shape of the printing surface that the latter is in contact with said stencil while the respective object is moved by said support means and said carrier component past said stencil is an arcuate path about said guide surface.

21. An apparatus as defined in claim 20, wherein said carrier component is a chain.

22. An apparatus as defined in claim 20, wherein said carrier component is a band.

23. An apparatus as defined in claim 20, wherein said carrier component is a rope.

24. An apparatus as defined in claim 20, wherein said one carrier component is arranged at one side of said path; said transporting means further including a similar additional carrier component arranged at an opposite side of said path.

25. An apparatus as defined in claim 20, wherein said flexing means further includes a plurality of rollers engaging said carrier component opposite said guide member.

26. An apparatus as defined in claim 20; and further comprising an elongated rail extending parallel to said plane and wherein said guide member is mounted on said rail.

27. An apparatus as defined in claim 20, wherein said flexing means is mounted for movement parallel to said plane and oppositely thereto at least during the printing operation.

28. An apparatus as defined in claim 20, and further including means for connecting each of said support members to the associated flexible carrier component for movement between two longitudinally spaced locations.

29. An apparatus as defined in claim 28, wherein said connecting means includes a slot at one of said carrier component and said support member, and a pin on the other of said support member and carrier component and slidably received in said slot.

* * * * *